US006260637B1

(12) United States Patent
Haussmann et al.

(10) Patent No.: US 6,260,637 B1
(45) Date of Patent: Jul. 17, 2001

(54) ROCK DRILL

(75) Inventors: August Haussmann, Ravensburg; Mathias Fuss, Weingarten; Bernhard Moser, Altshausen; Thomas Wagegg, Kisslegg, all of (DE)

(73) Assignee: Hawera Probst GmbH, Ravensburg (DE)

( * ) Notice: Subject to any disclaimer, the term of this patent is extended or adjusted under 35 U.S.C. 154(b) by 0 days.

(21) Appl. No.: 09/297,890

(22) PCT Filed: Nov. 11, 1997

(86) PCT No.: PCT/DE97/02658

§ 371 Date: May 11, 1999

§ 102(e) Date: May 11, 1999

(87) PCT Pub. No.: WO98/21442

PCT Pub. Date: May 22, 1998

(30) Foreign Application Priority Data

| | | |
|---|---|---|
| Nov. 11, 1996 | (DE) | 196 46 471 |
| Aug. 7, 1997 | (DE) | 197 34 093 |
| Aug. 7, 1997 | (DE) | 197 34 094 |

(51) Int. Cl.[7] ..... E21B 10/58
(52) U.S. Cl. ..... 175/420.1; 175/427
(58) Field of Search ..... 175/419, 420, 175/420.1, 427

(56) References Cited

U.S. PATENT DOCUMENTS

| | | | | |
|---|---|---|---|---|
| 2,575,438 | | 11/1951 | Alexander et al. . | |
| 2,628,821 | | 2/1953 | Alexander et al. . | |
| 5,184,689 | * | 2/1993 | Sheirer et al. | 175/420.1 |
| 5,269,387 | * | 12/1993 | Nance | 175/420.1 |
| 5,375,672 | * | 12/1994 | Peay et al. | 175/420.1 |
| 5,458,210 | * | 10/1995 | Sollami | 175/420.1 |
| 5,467,837 | | 11/1995 | Miller et al. . | |
| 5,482,124 | * | 1/1996 | Haussmann et al. | 175/420.1 |

FOREIGN PATENT DOCUMENTS

| | | |
|---|---|---|
| 29 12 394 A1 | 10/1980 | (DE) . |
| 81 04 116 U 1 | 8/1982 | (DE) . |
| 37 26 251 A1 | 2/1989 | (DE) . |
| 39 36 747 A1 | 5/1991 | (DE) . |
| 0 452 255 A2 | 10/1991 | (DE) . |
| 44 19 717 A1 | 12/1995 | (DE) . |
| 0 353 214 A2 | 1/1990 | (EP) . |
| 0 572 761 A1 | 12/1993 | (EP) . |
| 0 599 596 A1 | 6/1994 | (EP) . |
| 0 625 395 A1 | 11/1994 | (EP) . |

* cited by examiner

*Primary Examiner*—William Neuder
(74) *Attorney, Agent, or Firm*—Venable; Robert Kinberg; Catherine M. Voorhees

(57) ABSTRACT

A rock drill which has a cutting tip of roof-shaped design at its front end is proposed. In order to achieve a reduction in the loading of the carbide cutting tip or an increased drilling capacity in particular in concrete, the flanks are subdivided into flank sections in order to achieve a slimmer embodiment of the drill head.

23 Claims, 5 Drawing Sheets

ROCK DRILL

BACKGROUND OF THE INVENTION

The invention relates to a rock drill having a shank and a drill head with a cutting tip on its front end.

Conventional rock drills consist of a drill shank and a drill head, into which a carbide cutting element, which is roof-shaped in side view, is inserted (see FIG. 1 of EP 0 452 255 B1). The cutting element has lips or rake faces which are ground in a wedge shape on either side of the roof-shaped front end and in each case have a top cutting edge. In this case, the cutting edges are arranged so as to be laterally offset from a vertical center plane of symmetry, so that so-called chisel edges are produced (see FIG. 2 of EP 0 452 255 B1).

As a rule, the flanks arranged behind the end cutting edge in the direction of rotation have a flank angle of about 20°–30° compared with a conventional cutting edge angle or rake-face angle of 60°, the angles being measured being measured relative to a vertical plane to the longitudinal axis of the drill.

With regard to the design of such cutting tips, reference is additionally made to DE 81 04 116 U1, FIGS. 2 to 4 , and DE 29 12 394 A1, FIG. 1. Some of these drilling tools have secondary cutting tips or corresponding pins which are intended to serve the drilling advance.

The roof-shaped cutting tip made of carbide can pass completely through the drill head over its entire diameter and as a rule forms an additional lateral projecting length for forming the nominal diameter. Provided there are no secondary cutting tips or corresponding pins, the transition region from the drill helix to the drill head is designed as a supporting region for the cutting tip. In this case, to prevent dislodgement, the carbide cutting tip is supported laterally in the drill head by an appropriate, voluminous supporting body, retaining surfaces for the removal of the drillings being formed at the front end as a rule.

A drilling tool having a cemented-carbide insert has been disclosed by EP-A 0353 214, this drilling tool serving to cut rock. In order to produce a better brazed connection between the tool body and the sintered-carbide insert, additional side tips of sintered carbide, which embed the main sintered-carbide insert, are provided. In this case, the sintered-carbide insert is of symmetrical construction relative to its longitudinal center plane, side sections having a different point angle being provided, and these side sections lead to an improved brazed connection. A distinction between different rake faces and flanks is not provided in this tool.

SUMMARY OF THE INVENTION

The object of the invention is to improve a drilling tool of the type described above to the effect that drilling capacity in concrete is improved. At the same time, a lower loading of the carbide cutting tip is to be achieved.

Starting from a drilling tool having a shank and a drill head with at least one cutting tip on its front end pointing in a direction of feed of the drilling tool, this object is achieved by the at least tip having at least one cutting edge, a rake face with a negative rake-face angle ($\alpha$) and a flank located behind the at least one cutting edge where the flank is subdivided into a first flank section adjoining the at least one cutting edge and a second flank section wherein the rake-face angle ($\alpha$) is constant and is greater than a first flank angle ($\beta_1$) of the first flank section.

Advantageous and expedient developments of the design according to the main claim are specified in the subclaims.

Compared with known tools, the drill according to the invention has the advantage that markedly improved penetration into concrete is effected by lips which are not so "obtuse".

This results directly in a quicker drilling advance. The percussion power acting on the drilling tool is not transmitted to a conventional obtuse carbide cutting tip; on the contrary, the percussion power is converted on the whole, even more effectively, into drilling capacity by a markedly slimmer embodiment of the drill head. As a result, smaller tool dimensions may also be used in larger hammer drills without these smaller tools being damaged. Due to the design according to the invention of the front end of the carbide cutting insert, a lower loading of the carbide cutting tip itself takes place.

An essential basic idea of the invention is to modify the flank of the carbide cutting tip so that the flank is arranged on the back of a respective rake face, without involving the risk of fracture of the cutting edge. This is done according to the invention by each flank being subdivided into at least two flank sections, which, for example, may have the same widths, in which case the flank section pointing toward the side wall of the carbide cutting tip may have, for example, a flank angle which is approximately twice as large as the first flank section pointing toward the cutting edge. In this way, the flank is made to taper, so that the carbide cutting tip is of a tapered design, as seen in a side view, toward its narrow side. As a result, the carbide cutting tip, in a tool additionally shaped so as to be more acute overall, penetrates with low resistance into the material to be drilled, so that the percussion power leads to a quicker drilling advance.

In a special refinement of the invention, a conventional carbide cutting element, for example, is provided with a flank section at its respective flank, the flank section at its respective flank, the flank sections being divided approximately in half, for example, in their projected length directed upward. However, the flank sections may be designed to differ in their projected lengths and their flank angles.

A development of the invention provides for the rake face to be designed with an increased rake-face angle of >60°, in particular about 70°, compared with a conventional embodiment. In this case, depending on the optimization of the drilling tool, the rake face may be designed to be flat or concave or convex. Here, the tangential or aligned transition to the supporting surface for the carbide cutting tip is important. If it was previously assumed that a further increased in the rake-face angle and thus an even more acute design of the carbide cutting tip leads to an increased risk of fracture of the point of the carbide cutting tip, then extensive tests have shown that the improved disposal of the drillings from such a lip increases the loading capacity.

The widening of the rake face in the direction of the center axis of the drill is also to be seen in this connection, since the width of the chisel edge is thereby reduced.

In an independently patentable development of the invention, the carbide cutting tip designed according to the invention with a second flank angle is integrated in a drill head whose lateral supporting body for the carbide cutting tip is designed to be very slim and likewise tapered. Compared with a conventional drilling tool having voluminous end supporting surfaces, the lateral supporting surfaces, according to the invention, are therefore designed as lateral surfaces which are tapered as far as possible and, for example, are concave or arched or even flat in their outer contour. This design results in a sharply tapered, arrow-shaped side view of the drill head with a carbide cutting tip. In this case, it is especially expedient if the outer contour is designed to be flat, convex or concave, the supporting surfaces for the carbide cutting tip and thus the outer contour of the drill head merging virtually tangentially or completely tangentially or asymptotically into the rake face and respectively the flank of the carbide cutting element. This results in a flat or an inwardly arched surface in a view of the narrow side of the carbide cutting element, and this surface, in its upper region, runs in an at least partly tapered manner into the rake face or respectively the flank or respectively the side wall of the carbide cutting element. End retaining surfaces are thereby avoided. This measure at the drill head can also lead to the desired effect with a conventionally designed cutting tip.

BRIEF DESCRIPTION OF THE DRAWINGS

Further details and advantages of the invention are explained in more detail below with reference to exemplary embodiments and are shown in the drawing, in which.

DETAILED DESCRIPTION OF THE INVENTION

Figure 1:
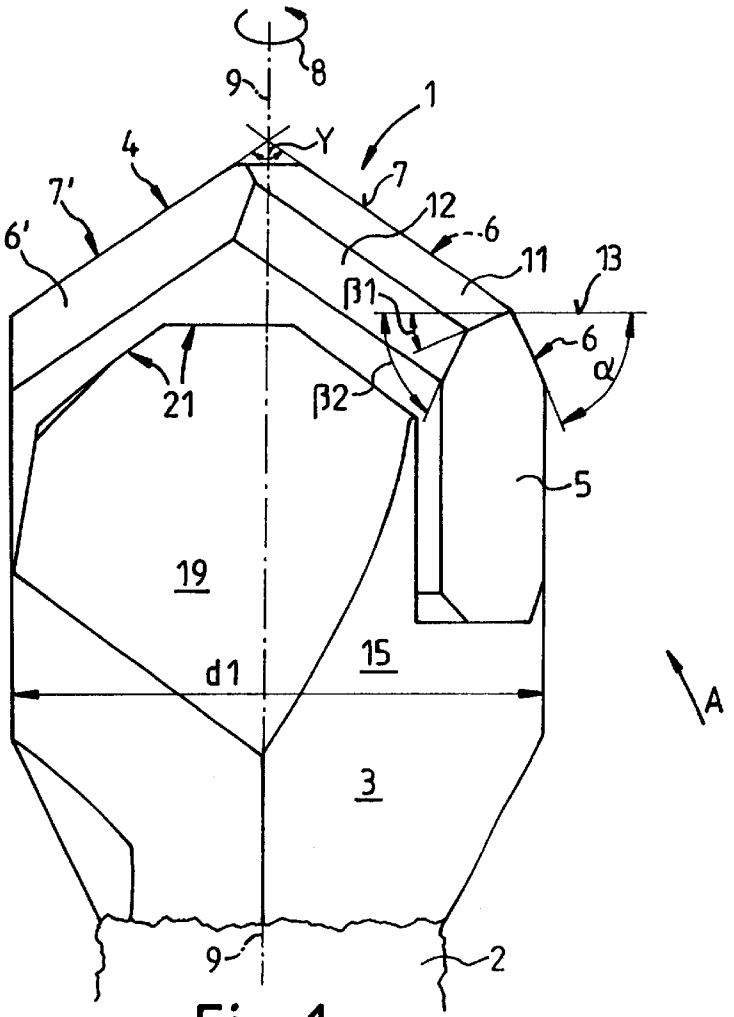
FIG. 1 shows a perspective view of the drill head of a drilling tool according to the invention in a first exemplary embodiment.

In a first exemplary embodiment, the rock drill 1 according to the invention has a drill shank 2 (a portion shown schematically) and a drill head 3, which, at its front end 4 pointing in the feed direction 16, has a cutting tip 5 extending generally over the diameter D1 and of roof-shaped design from a view of its wide side. This cutting tip 5, on both sides of its roof-shaped design, has lips or rake faces 6, 6', which point with the angle $\gamma$ in the direction of rotation 8, are ground on in a wedge shape and have a negative rake-face angle $\alpha$ and a cutting edge 7, 7' formed at the front end.

The tool according to FIG. 1 rotates counterclockwise according to arrow 8 about the longitudinal axis of symmetry 9 of the tool.

Figure 3A:
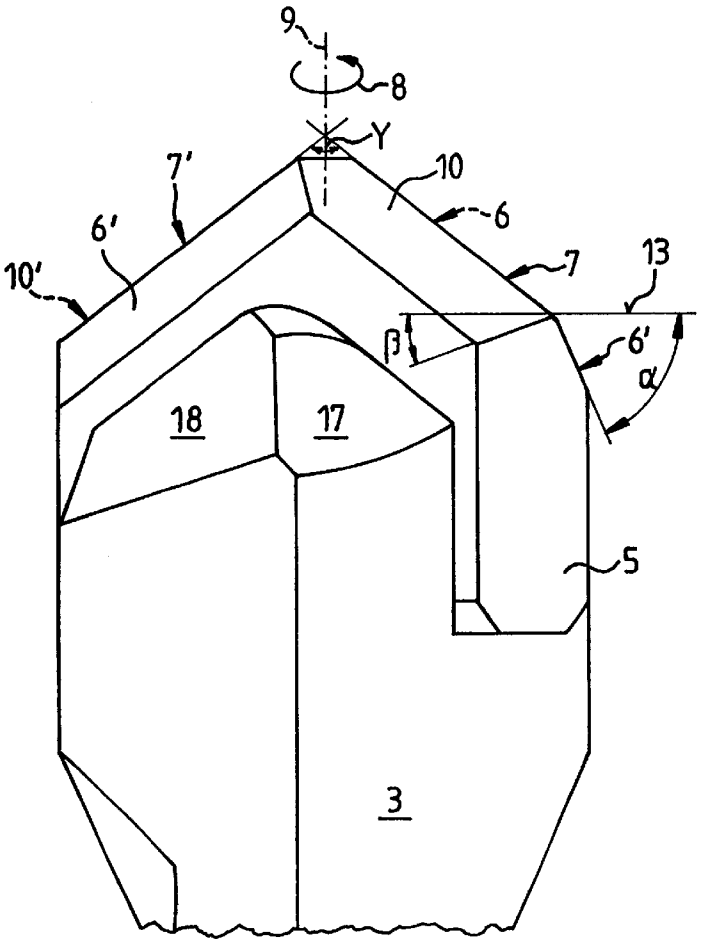
FIG. 3*a* shows a conventional tool in comparison with the representation according to FIG. 1.
Figure 3B:
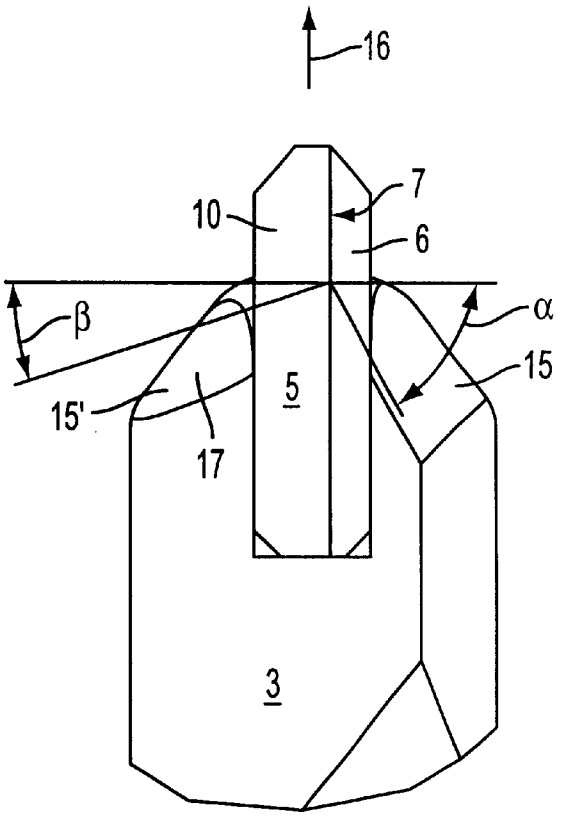
FIG. 3*b* shows the conventional tool in comparison with the representation according to FIG. 2.

In the case of the conventional tool in accordance with the representation according to FIGS. 3*a* and 3*b*, the so-called flank 10, 10', having a flank angle $\beta$ of about 20° to 30° as normal value, is located on the back of the respective rake face 6, 6'. In this case, the smaller value applies to drilling tools having a smaller nominal diameter (e.g. $\leqq$12 mm), and the larger value applies to those drilling tools having a larger nominal diameter. The rake-face angle $\alpha$ in the case of conventional tools is $\alpha \cong 60°$.

According to the invention, the known flank 10, 10' is now subdivided into two flank sections 11, 12. In this case, the first flank angle $\beta 1$ of the first flank section 11 is $\beta 1 \cong 20$ to 40° and in particular $\beta 1 = 20°$ to 30°. Here, the smaller value again applies to nominal diameters $\leqq$12 mm, for example, and the larger value applies to nominal diameters above this. The second flank angle $\beta 2$ of the second flank section 12 is $\beta 2 \cong 40$ to 70° and in particular $\beta 2 = 60°$. In this case, the flank angles $\beta 1$, $\beta 2$ are measured relative to a plane 13 lying perpendicularly to the drill axis 9.

Figure 2:
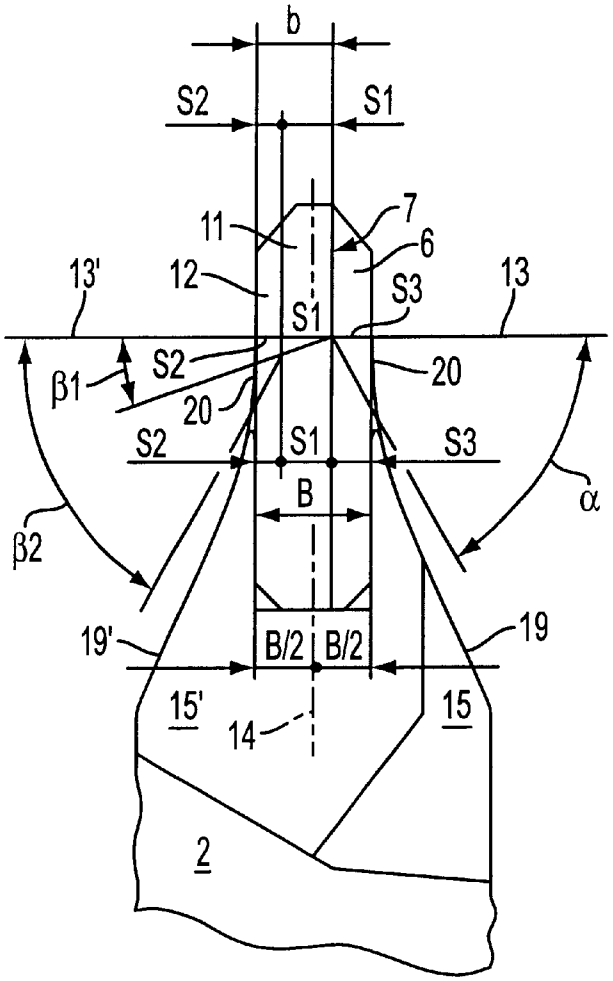
FIG. 2 shows a side view from perspective A in FIG. 1 of the tool according to the invention, in which case only the right-hand half of FIG. 1 with its roof-shaped cutting tip can be seen.

As can be seen when comparing FIG. 1 with FIG. 3*a* and FIG. 2 with FIG. 3*b*, the cutting tip 5 is designed to be markedly more acute by the subdivision of the known flank 10 into two flank sections 11, 12, i.e. the otherwise rather flat flank 10, 10' in the prior art having a flank angle of $\beta \cong 30°$ is designed to be substantially more acute by the additional beveling of the second flank section 12 at an angle of $\beta 2$. As a result, the front end of the carbide cutting tip 5 becomes slimmer.

Provided as an alternative is a similar geometrical design consisting of more than two flank sections (polyline) or as a convex surface, which represents the limit case of the polyline.

As can also be seen from FIGS. 1 and 2, the first flank section 11 adjoining the end cutting edge 7 has a projected length $S_1$ lying in the plane 13 and the adjoining second flank section 12 has a projected length $S_2$, the sum of which is defined as length b. The ratio $S_1$:$S_2$ may vary depending on the application and is also selected not least in coordination with the projected length $S_3$ of the rake face 6. For example, $S_1$ may be $\cong$(0.4 to 0.7)×b.

The overall width of the cutting tip 5 is designated by B, where $B = S_1 + S_2 + S_3$.

As FIG. 2 shows, the end cutting edge 7 between rake face 6 and flank 11 of the carbide cutting tip 5 is arranged eccentrically to the vertical center plane 14 of the cutting tip 5. In this case, the projected length $S_3$ of the rake face 6 may be about ⅓ to ⅙, in particular ⅕, of the overall width B of the cutting tip 5.

It can be seen from the representation of the prior art in FIGS. 3*a* and 3*b* that supporting bodies 15, 15' of large volume are provided at the side of the cutting tip 5 in order to avoid dislodgement of the cutting tip 5 during loading. This supporting body 15, 15' is preferably obtained by a milling or drill-point grinding operation on the drill head 3, in which case wide surface sections 17, 18 are obtained in the drilling direction 16 on either side of the carbide cutting tip, and these surface sections 17, 18, in the prior art, constitute a type of obstruction surface or retaining surface for the material to be drilled.

In an inventive development of the invention, these supporting bodies 15, 15' are now made sharply tapered by a grinding operation, so that side-wall sections 19, 19', i.e. outer contours according to FIGS. 1, 2, are obtained in the drill head, and these side-wall sections 19, 19' are designed, for example, so as to be two-dimensional to a very large extent and in particular cylindrical or concave or even flat and thus no longer form end retaining surfaces. This arrangement can be seen especially clearly from FIG. 2, in which case a concave design of the outer contour 19, 19' of the supporting body in the drill head is preferably selected, and the region pointing toward the front end leads virtually tangentially or asymptotically into the side wall 20 of the carbide cutting tip 5. This results in the sharply tapered arrangement, shown in FIG. 2, of the drill head and cutting element, and this arrangement permits better penetration into the concrete, since the retaining surface, directed toward the front, from FIG. 3 is substantially reduced or is completely omitted. This is preferably or alternatively done in combination with the additional surface section 12 of the second flank and results in a virtually arrow-shaped and tapered arrangement of the lateral supporting body relative to the carbide cutting tip. The top transition region 21 between supporting body 15 and cutting tip 5 runs out approximately tangentially.

The supporting side wall 19, 19' of the drill head consequently forms a side flank having a curved or arched or cylinder-segment-shaped, i.e. concave, outer contour.

In the exemplary embodiment according to FIGS. 1 and 2, the rake-face angle $\alpha$ (also called rake angle) may be made in the order of magnitude of $\alpha \cong 60°$, which corresponds to a conventional value for a rake angle.

Figure 4A:
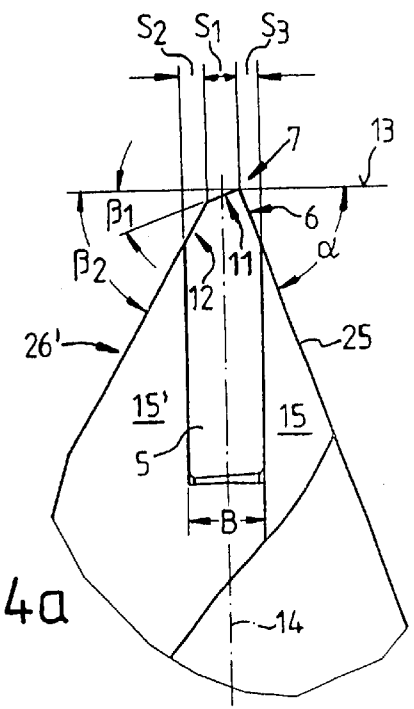
FIG. 4*a* shows an enlarged representation on a scale of 5:1 of the representation according to FIG. 4.
Figure 4:
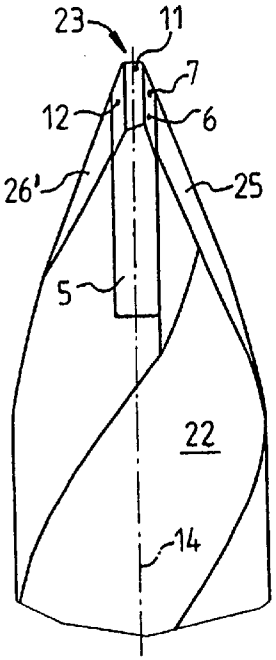
FIG. 4 shows a further exemplary embodiment of a drilling tool according to the invention having an altered head geometry.
Figure 5:
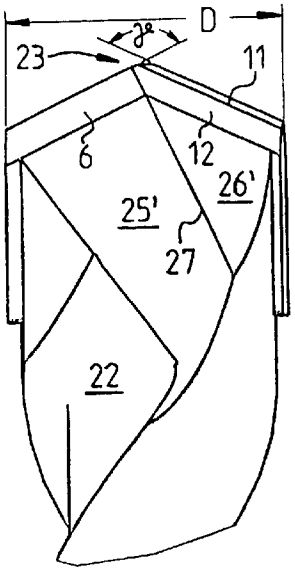
FIG. 5 shows a side view of the exemplary embodiment according to FIG. 4.

In the alternative exemplary embodiments according to FIGS. 4 and 5, the negative rake angle $\alpha$ of the rake face 6 is selected to be between 60 and 80°, in particular $\alpha \cong 70°$. If it has previously been assumed that a rake angle >60° leads to increased wear and in particular also to increased risk of fracture of the carbide cutting tip, such a rake angle is preferably deliberately used in the present invention.

In general, the making of acute angles is problematic in carbide manufacture. On the one hand, inadequate compaction of the blank may be the cause of premature failures. On the other hand, in the case of acute angles, the loading for the mold for the pressing and sintering is also very high, so that an increased risk of fracture arises here during manufacture.

The development of new carbide grades which are harder and thus more wear-resistant, but have a toughness similar to previous grades, has certainly led to a reduced wear behavior, but the risk of fracture has up to now still been estimated to be very high.

Surprisingly, however, tests have shown that, even with previous carbide grades, the wear and thus the risk of fracture, despite an increase in the rake angle, do not increase if the percussion energy in the rock is converted in an optimum manner and the power loss at the drill head is reduced. Such a configuration appears all the more because the removal of the drillings away from the drill point runs optimally if no retaining surfaces which obstruct the transport of the drillings oppose the disposal of the drillings. Consequently, if the carbide tip is embedded in the drill head in such a way that a sharply tapered drilling tool is obtained overall, this helps the transport of drillings from the carbide tip into the flutes, so that no additional friction occurs in the region of the drill head or in the region of the carbide cutting tip. The forming of a second or larger clearance angle also has a positive effect in this sense.

A further problem lies in the development and type of construction of modern drilling machines or hammer drills, which have increased enormously in their percussion power. Whereas a hammer drill of an older type of construction only has a fragmenting action when striking the rock, the tool, when used in a new type of hammer drill, is perfectly able to penetrate somewhat into the rock. In this case too, it is especially favorable if the striking surface is kept as small as possible and the drill point is as slim as possible overall.

These findings lead to a drilling tool of the type according to the invention and in particular to a further development with a drilling tool according to FIGS. 4 to 7.

In the representation according to FIG. 4 or in the enlarged representation according to FIG. 4*a*, the rake angle $\alpha$ is made to be $\alpha$>60° and in particular $\alpha \cong 70°$. At the same time, the side walls 25, 25' supporting the carbide cutting tip merge asymptotically or tangentially into the rake face 6, so that a slim head overall, without retaining surfaces opposing the drillings, is obtained.

Again provided behind the cutting edge 7 are the two flank sections 11, 12, having a flank angle or clearance angle $\beta 1 \cong 20$ to 40° and in particular $\beta 1 \cong 20°$ and a flank angle or clearance angle $\beta 2$ 40 to 60° and in particular $\beta 2 \cong 60°$. In this case, the second flank section 12 again merges tangentially or asymptotically into the further side wall 26, 26', so that an extremely slim drill head without the retaining surfaces opposing the drillings is also formed on this side. The side walls 25, 26 and 25', 26' respectively are separated by the break line 27 (see FIGS. 5 and 7).

As can be seen from FIG. 4*a* in an enlarged representation (5:1) of FIG. 4, the lengths $s_1$ to $s_3$, projected into the horizontal plane 13, of the flank sections 11, 12 and of the rake face 6 are formed. The actual lengths of the flank sections 11, 12 and of the rake face 6 respectively result from the projected lengths $s_1$ to $s_3$ divided by the cosine of the respective angle $\beta 1$, $\beta 2$ and $\alpha$.

In addition, the same parts in FIGS. 4 to 5 are provided with the same designations as specified with respect to FIGS. 1 and 2.

Figure 7:
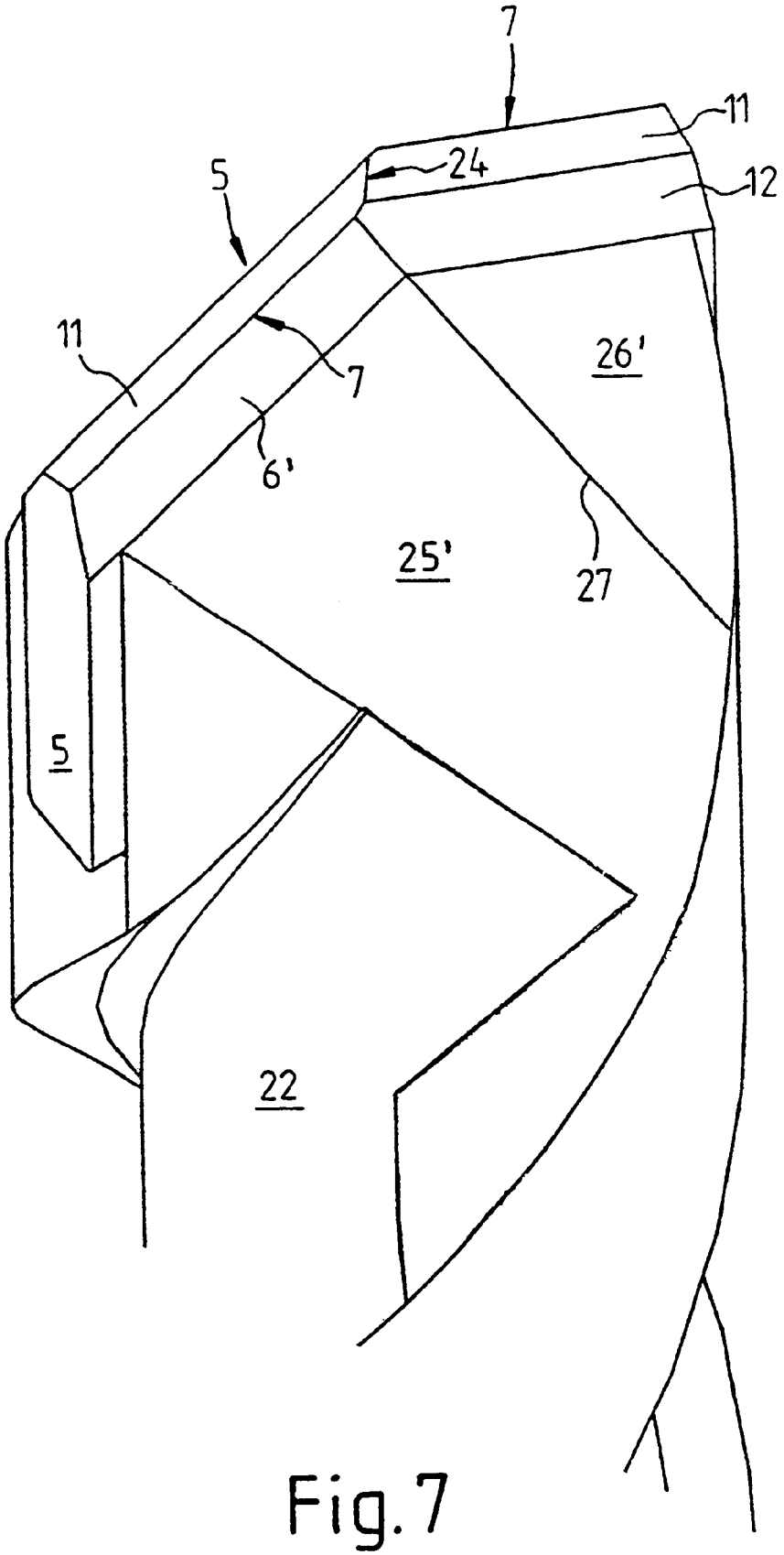
FIG. 7 shows a perspective view of the representation according to FIGS. 4 and 5.

A side view of the wide side of the cutting tip 5 is shown in FIGS. 5 and 7. The flank sections 11, 12 can be seen in the right-hand part of the figures and the rake face 6 can be seen in the left-hand part of the figures, together with the respective side-wall sections 25', 26' running tangentially toward these surface sections. The drillings cut by the rake face 6' migrate from the side-wall section 25' lying in front of the rake face 6' into the following flute 22 (see perspective representation in FIG. 7).

Figure 5A:
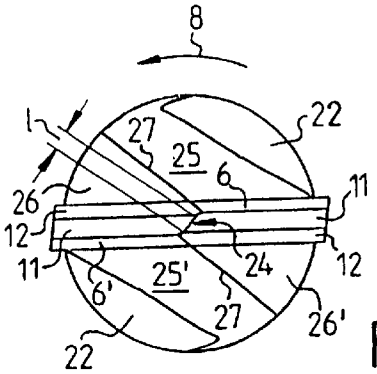
FIG. 5*a* shows a plan view of the exemplary embodiment according to FIG. 5.

On account of the cutting tip 5 of roof-shaped design and the rake faces 6 and flank sections 11, 12 respectively arranged eccentrically with respect to the center plane 14, a so-called chisel edge 24 is obtained in the region of the center drill point 23, as can be seen in particular in the plan view of FIG. 5*a*. On account of its central arrangement in the region of the drill point 23, this chisel edge 24 has virtually no circumferential velocity and therefore acts like a single-point tool. A specially advantageous development of the invention is therefore the fact that the length l of the chisel edge 24 is kept as small as possible so that this chisel edge 24 acts as far as possible as a point.

Figure 6B:
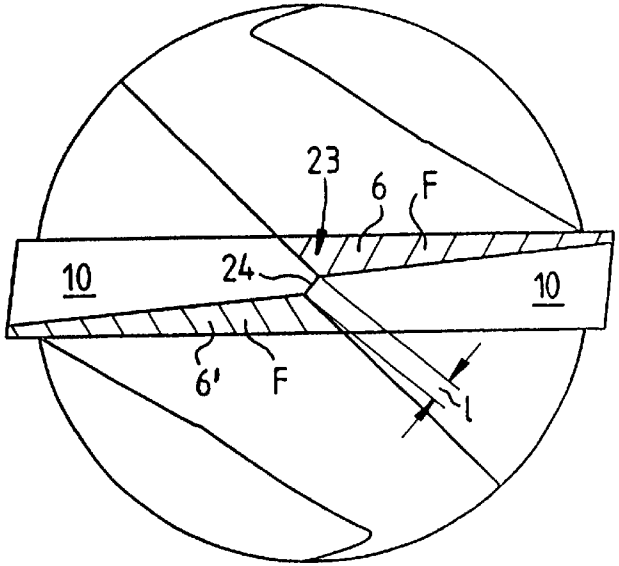
FIGS. 6*a–c* show alternative embodiments of the embodiment according to the representation in FIG. 5*a; and*
Figure 6C:
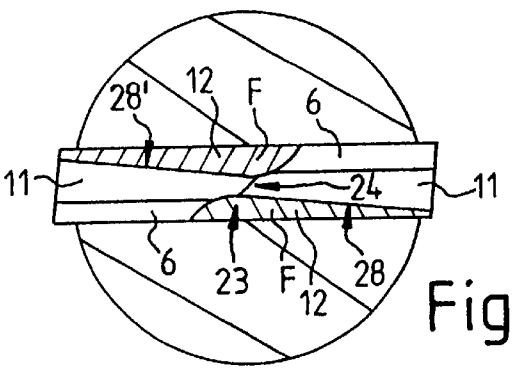
Figure 6A:
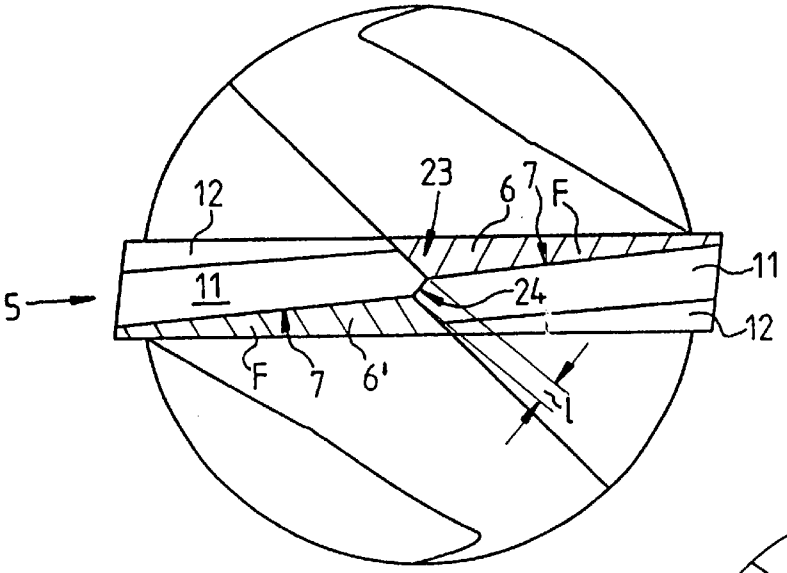

In order to improve this, the respective rake face 6, 6', according to the representation in FIGS. 6*a b,* is designed in such a way that it increases in its width (as seen in plan view) toward the drill point 23 (see hatched area F) . This leads to a reduction in the size of the chisel edge 24, i.e. the length l is shortened. If this increase in width toward the drill point 23 is carried out at both rake faces 6, 6', the chisel edge shown in plan view in FIG. 5*a* can therefore be greatly reduced in its length l, so that virtual point contact is obtained during the drilling-in operation in the region of the drill point 23. In the ideal case $l \approx 0$.

In FIG. 6*a*, the cutting tip 5 is shown with a first flank section 11 and a second flank section 12, as described with reference to FIGS. 1, 2 as well as FIGS. 4 and 5. In FIG. 6*b*, only one flank 10 is shown symbolically, but likewise with a shortened chisel edge 24 on account of the above facts.

In connection with the facts described above, the second flank sections 12 may likewise also be enlarged in their width (as seen in plan view) toward the center in order to additionally lead here to a reduction in the length l of the chisel edge 24 (see area F) . This is shown symbolically in FIG. 6*c* with the edge 28, 28' between the first and second flank sections 11, 12. In the ideal case, this again leads to virtual point contact in the region of the drill point 23. In FIG. 6*c*, the rake face 6, in its width as seen in plan view, is designed to run parallel to the outer surface.

According to the measures in accordance with the invention, an optimized head geometry is achieved for optimum drilling advance with optimum removal of drillings. In particular, the measures according to the invention realize a slim drill head in which both the rake angle α is increased compared with a conventional type and two flank sections are provided. Of course, instead of two flank sections, if need be a plurality of flank sections, which produce a type of polyline, may also be used. A convexly arched outer contour, which represents a type of "limit polyline", may also be used for the flank 10. The tapered arrangement of the cutting tip having a smooth transition into the side wall of the drill head is decisive. On the one hand, as wide a passage as possible is opened by such a slim drill head, the drillings being offered the least possible resistance. A slim drill head also does not reduce the life of the drilling tool. The opposite is more likely with the measures according to the invention. This is explained essentially by the fact that the enormous percussion energy of the power tool can be transferred into the rock in a substantially more effective manner, as a result of which the tool is protected. Tests have shown that an optimum drilling capacity and tool life are achieved when cutting edge angle and drill head tool face merge into one another tangentially, a factor which applies to both the rake angle and the clearance angle.

Provided the rake face 6 is additionally designed to be slightly concave, i.e rounded-out, this may be an additional advantage. This applies in particular to an improved cutting capacity in reinforcement. The radial curvature produces coarser chips, i.e. the cutting work is decreased overall, which also prolongs the tool life.

The advantage of the convex cutting tip having a convex rake face 6 also lies in the fact that the convex cutting tip permits an even slimmer drill head. Here, however, the overall stability has to be kept in mind. Although the drilling capacity can be increased even further compared with the embodiment described previously, the risk of head fracture increases. For special applications, however, such an embodiment is extremely suitable, specifically for soft or moist rock. However, harder concrete or thicker silica or even reinforcement in general are not cut with a convex cutting tip.

If need be, the invention may of course also be designed with a single flank 10 of the cutting tip 5, in which case this flank 10 may be provided with a clearance angle which is steeper than usual. Here, in particular clearance angles between 35 and 50° and in particular 40° ought to be selected.

Furthermore, a development of the invention provides for the drill head to have one or more cutting tips or a secondary cutting tip and a plurality of secondary cutting elements, the main cutting tip and/or the secondary cutting elements having the abovementioned characteristic features. The invention therefore also relates in particular to the protection of such carbide cutting elements as such without restriction to a certain geometry of the drill head.

The invention is not restricted to the exemplary embodiment shown and described. On the contrary, it also comprises all developments by persons skilled in the art within the scope of the patent claims. In particular, other combinations of the technical features mentioned above may be selected.

What is claimed is:

1. A rock drill having an axis, a shank and a drill head having at least one cutting tip on a front end of the drill head pointing in a direction of feed of the drill, comprising:

at least one cutting edge provided at the front end of the at least one cutting tip;

a rake face located in front of the at least one cutting edge and having a negative rake-face angle (α), said rake face outwardly extends along and from the at least one cutting edge; and a flank located behind the at least one cutting edge, the flank being subdivided into a first flank section adjoining the at least one cutting edge, having a first flank angle ($\beta_1$), and a second flank section outwardly extending along and from the first flank section, the first flank section being between the at least one cutting edge and the second flank section, wherein the rake-face angle (α) is constant, the rake-face angle (α) being greater than the first flank angle ($\beta_1$) of the first flank section.

2. The rock drill as claimed in claim 1, wherein the first flank section has a first flank angle (β1)≈20 to 40°, the second flank section has a second flank angle (β2)≈40 to 60°, and the rake-face angle (α) and the first and second flank angles (β1, β2) are defined relative to a plane lying perpendicularly to the drill axis.

3. The rock drill as claimed in claim 1, wherein the first flank section adjoining the at least one cutting edge has a projected length $S_1$ lying in a plane, and the second flank section adjoining the first flank section has a projected length $S_2$, the sum of which results in a length b, where $S_1 \geqq (0.4 \text{ to } 0.7) \times b$.

4. The rock drill as claimed in claim 1, wherein the at least one cutting tip is made of carbide and has an overall width B, an end of the at least one cutting edge lies eccentrically to a center plane of the at least one cutting tip, the rake face has a projected length $S_3$ which is about ⅓ to ⅙, of the overall width B of the at least one cutting tip.

5. The rock drill as claimed in claim 4, wherein the projected length $S_3$ of the rake face is approximately ⅕ of the overall width B of the at least one cutting tip.

6. The rock drill as claimed in claim 1, wherein the rake face is designed to be flat.

7. The rock drill as claimed in claim 1, wherein the at least one cutting tip has a rake-face angle (α) of 60° to 80°.

8. The rock drill as claimed in claim 7, wherein the rake-face angle (α) is approximately 70°.

9. The rock drill as claimed in claim 1, wherein, the drill head has a supporting body provided on either side of the at least one cutting tip, the at least one cutting tip has a sidewall, and the at least one cutting tip is embedded in the drill head in such a way that the supporting bodies have an outer contour which merges or leads virtually or directly tangentially into one of the second flank section, the rake face and the side wall of the at least one cutting tip.

10. The rock drill as claimed in claim 9, wherein the supporting body of the drill head has one of a cylinder-segment-shape, a concavely arched contour and a flat outer contour, said supporting body forming no end retaining surfaces and leading into the side wall of the at least one cutting tip.

11. The rock drill as claimed in claim 9, wherein the outer contour of the supporting body in the drill head is designed to be at least partly convex.

12. The rock drill as claimed in claim 1, wherein the drill head has a diameter $D_1$, and the cutting tip extends at least over the entire diameter $D_1$ of the drill head and, in view of its wide side, is designed in a roof shape with an apex angle $\gamma \cong 130°$.

13. The rock drill as claimed in claim 1, wherein the drill head has a main cutting tip and a plurality of secondary cutting elements.

14. The rock drill as claimed in claim 1, wherein the first flank angle of the first flank section is approximately in the range of 20° to 30°.

15. The rock drill as claimed in claim 1, wherein the second flank section has a second flank angle of approximately 60°.

16. The rock drill as claimed in claim 1, wherein the rake-face is one of convex and concave.

17. A rock drill having a shank and a drill head having at least one cutting tip on a front end of the drill head pointing in a feed direction, comprising:

at least one cutting edge provided at the front end of the at least one cutting tip;

a rake face located in front of the at least one cutting edge and having a negative rake-face angle ($\alpha$); and a flank located behind the at least one cutting edge and having a flank angle ($\beta$), wherein the rake face is a single rake face and the rake-face angle ($\alpha$) is constant and is between 60° and 80°, the at least one cutting tip being embedded in the drill head and having side walls, and the drill head having supporting bodies, so that the supporting bodies of the drill head provided on a side of the at least one cutting tip have an outer contour which tapers into the side walls of the at least one cutting tip without forming end retaining surfaces.

18. The rock drill as claimed in claim 17, wherein the flank has a correspondingly convexly arched contour.

19. A drilling tool as claimed in claim 17, wherein the at least one cutting tip has a rake-face angle $\alpha$ approximately equal to 70°.

20. The rock drill as claimed in claim 17, wherein the flank is a single flank and the flank angle ($\beta$) is approximately 35 to 50°.

21. The rock drill as claimed in 20, wherein the flank angle ($\beta$) is approximately 40°.

22. A rock drill having a shank and a drill head having at least one cutting tip on a front end of the drill head pointing toward a drill point in a feed direction, said at least one cutting tip comprising:

a drill point;

a cutting edge provided at the front end of the at least one cutting tip on each side of the drill point;

a rake face located in front of each cutting edge and having a negative rake-face angle ($\alpha$);

a flank located behind each cutting edge and having a flank angle ($\beta$), the flank being subdivided into at least a first flank section adjoining each cutting edge and a second, outer flank section; and a chisel edge formed between the rake face and the second, outer flank section on each side of the drill point, wherein at least one of the rake face and the second, outer flank section on each side of the drill point increases in width toward the drill point in order to reduce a length of the chisel edge.

23. A rock drill having a shank and a drill head having at least one cutting tip on a front end of the drill head pointing toward a drill point in a feed direction, comprising:

a drill point;

a cutting edge provided at the front end of the at least one cutting tip on each side of the drill point;

a rake face located in front of each cutting edge and having a negative rake-face angle ($\alpha$);

a flank located behind each cutting edge and having a flank angle ($\beta$); and a chisel edge extends between the rake face and the flank on each side of the drill point, wherein the rake face increases in width toward the drill point in order to reduce the length of the chisel edge.

* * * * *